US006558235B2

(12) United States Patent
Berg et al.

(10) Patent No.: US 6,558,235 B2
(45) Date of Patent: May 6, 2003

(54) ERGONOMIC SANDER HANDLE APPARATUS AND METHOD

(75) Inventors: Frederic P. Berg, Seattle, WA (US); Karl J. Schaefer, Everett, WA (US)

(73) Assignee: The Boeing Company, Seattle, WA (US)

( * ) Notice: Subject to any disclaimer, the term of this patent is extended or adjusted under 35 U.S.C. 154(b) by 114 days.

(21) Appl. No.: 09/805,542

(22) Filed: Mar. 13, 2001

(65) Prior Publication Data

US 2002/0132570 A1 Sep. 19, 2002

(51) Int. Cl.[7] ..... B24B 23/00
(52) U.S. Cl. ..... 451/41; 451/357
(58) Field of Search ..... 451/344, 357, 451/359, 354, 549, 558, 41

(56) References Cited

U.S. PATENT DOCUMENTS

| | | | | |
|---|---|---|---|---|
| 2,507,052 A | * | 5/1950 | Robinson | 451/353 |
| 3,375,617 A | * | 4/1968 | Kaufman et al. | 451/359 |
| 3,436,869 A | | 4/1969 | Zowe | |
| 4,380,270 A | | 4/1983 | Ludwig | |
| 4,462,381 A | * | 7/1984 | Fushiya et al. | 451/359 |
| 4,467,565 A | | 8/1984 | Wallace et al. | |
| 4,590,713 A | * | 5/1986 | Yasui | 451/357 |
| 4,624,078 A | | 11/1986 | Van Rijen et al. | |
| 5,074,081 A | | 12/1991 | Beth et al. | |

FOREIGN PATENT DOCUMENTS

| | | | | |
|---|---|---|---|---|
| AU | 722596 | * | 8/2000 | 451/344 |
| BE | 568608 | * | 11/1960 | 451/344 |
| GB | 2063727 | * | 6/1981 | 451/359 |

* cited by examiner

*Primary Examiner*—Robert A. Rose
(74) *Attorney, Agent, or Firm*—Alston & Bird LLP

(57) ABSTRACT

An ergonomic sander handle for clamping onto a sanding device so that the ergonomic handle can be comfortably gripped by a worker and used to apply the sanding device to a surface, is provided. The ergonomic handle includes an elongate body, a clamp head and a bearing. The elongate body is typically a cylindrical aluminum tube with padding for easy and comfortable gripping. One end of the elongate body is attached the clamp head that attaches to the sanding device. The other end of the elongate body is attached to the bearing which may include a pair of roller balls. To sand a surface, the worker grips the elongate body in a power grip (without significant wrist flexion or deviation) and applies pressure to urge sanding device and the bearing onto the surface. The power grip minimizes loads on the wrist and hand which reduces the likelihood of musculoskeletal trauma.

35 Claims, 7 Drawing Sheets

100
14
16
40
32
48
50
31
27
45
28
51
36
15
37
17
39
20
13
38
19
23
12
21
11
10

100
14
16
40
32
48
51
27
31
50
51
36

15
17
37
39
19
13
23
38
21
12
20
11
10
110

ERGONOMIC SANDER HANDLE APPARATUS AND METHOD

FIELD OF THE INVENTION

The present invention relates to the field of hand operable sanding devices. More particularly, the present invention relates to an easily gripped handle that can be affixed to an existing palm sander device that reduces cumulative hand and wrist trauma.

BACKGROUND OF THE INVENTION

Sanding is an abrasive process that requires that two surfaces rub together and is extremely time consuming and tedious when performed manually. Various power-driven sanders have been available for some time and frequently require the use of two hands due to excessive weight. Belt sanders are one type of hand sander that is available but these are generally used for roughly removing large amounts of material. Belt sanders themselves are heavy and are not recommended for one-handed operation. Two handed sanders have limited usefulness on vertical and overhead surfaces because of their size and weight.

Sanders that can be operated with one hand include oscillating and random orbit palm sanders. Random orbit palm sanders are pneumatically powered and typically have a small power head with a trigger paddle attached to the top. On the bottom of the random orbit palm sander is a small, typically about six-inch diameter, sanding disc that is fixed to a spinning pad. A random orbit action is achieved by use of an eccentric weight or cam in the drive which causes the pad to orbit a center point while spinning at a high speed with respect to the power head. The random orbit pattern is necessary to produce a mechanical action that results in a swirl free finish. However, the random oscillation transfers considerable vibration to the operator's hand and the operator must grip the power head tightly with his or her fingers to both control the action and maintain palm pressure on the trigger paddle. Oscillating sanders are generally less effective in producing a swirl-free surface and are therefore not as desirable in many applications.

Regardless of the type, oscillating, random orbit or other, all power hand sanders produce some vibration. Operators cannot be completely isolated from vibration because the operator must apply pressure to some degree in order for the sanding disc to remove material from the surface being sanded. Heavier sanders aid in pressure application but, as mentioned above, they are limited to use in vertical and overhead surfaces.

One industry that requires a significant amount of sanding labor is the aerospace industry. Sanding is typically required on both the aluminum fuselages and on composite control surfaces and panels of aircraft before the application of paint or for the removal of old paint in a paint hanger. Because of the nature of the fuselage and its surface shapes, one-handed control of the sander and use of the sander on vertical surfaces and overhead surfaces is necessary. The tight grip required to use the sanders in a paint hanger can reduce blood flow to the fingers and result in musculoskeletal stress that is further exacerbated by vibration. In addition, when sanding a vertical or overhead surface in a fuselage, the operator's wrist is typically extended which results in greater musculoskeletal stress. Prolonged exposure to these conditions can lead to Raynaud's disease and/or carpal tunnel syndrome. Raynaud's disease is commonly called "white finger" and results in numbness, cold skin and a blue color when exposed to cold temperatures. Raynaud's disease can be a permanent condition. Carpal tunnel syndrome is an inflammation of the flexor tendons of the fingers which pass through a channel on the palmer side of the wrist formed by the carpal bones and the transverse carpal ligament. These flexor tendons become inflamed with repetitive overuse and place pressure on the nearby median nerve. Pressure on the median nerve causes numbness and/or pain in the lower arm. Carpal tunnel syndrome can also result in permanent dysfunction.

Small oscillating detail sanders solve some of the repetitive motion problems by having a very short stroke at a very high frequency with a low weight. This greatly reduces vibration that is transmitted to the hand of the operator. However, the area and mass of the sanding pad must be kept too small to be of any practical value on large surfaces, such as those encountered when sanding an aircraft fuselage. Automated sanding machines have been used on fuselages, but oftentimes fail to reliably negotiate vertical and overhead surfaces.

Therefore, it would be advantageous to have an operable sanding device that is easily gripped with one hand or both hands and can be used to negotiate large sanding surfaces. In addition, it would be advantageous to have a sanding device that is light in weight and transmits minimal vibrations to reduce the incidence of cumulative trauma to the hand and wrist of the operator.

SUMMARY OF THE INVENTION

The present invention includes an ergonomic sander handle for a sanding device that reduces the incidence of cumulative trauma to the hand of a worker using the sanding device. The sander handle provides an ergonomic grip by having an elongated tubular body attached to the sanding device at one end and a bearing at the other end. The handle can be gripped by the worker with a single hand in an anatomically friendly position without flexion or deviation of the hand and wrist. In addition, the ergonomic handle is of light-weight construction to reduce loads on the hand and wrist of the operator when sanding vertical and overhead surfaces, such as the fuselage of an airplane.

In one aspect of the invention, an ergonomic handle for clamping onto a sanding device so that the ergonomic handle can be gripped by a worker and used to apply the sanding device to a surface, is disclosed. The ergonomic handle includes an elongate body, a clamp head and a bearing. The elongate body has a head end and an opposing tail end. The clamp head is attached to the head end of the elongate body and is operable to clamp the sanding device. The bearing is attached to the tail end of the elongate body, opposite the clamp head. In use, the worker clamps the clamp head onto the sanding device, grips the elongate body, applies the sanding device and bearing to the surface and moves the sanding device and bearing along the surface during sanding.

In another aspect of the invention, an ergonomic sander that can be gripped by a worker and used to sand a surface, is disclosed. The ergonomic sander includes an elongate body, a sanding head and a bearing. The elongate body has a head end and an opposing tail end. The ergonomic sander also includes a sanding head that is attached to the head end of the elongate body and has a sanding interface operable to sand the surface. The bearing is attached to the tail end of the elongate body, opposite the sanding head. In use, the worker clamps the clamp head onto the sanding device, grips the elongate body, applies the sanding device and bearing to the surface and moves the sanding device and bearing along the surface during sanding.

The bearing can include a fluoropolymer resin pad (e.g., a Teflon® material) or a pair of freely rotating roller balls. The bearing can include a hinge that allows it to pivot with respect to the tail end of the elongate body. The bearing can also include a height-adjustable bracket mounted to the tail end of the elongate body and operable to adjust the height of the handle with respect to the bearing. The bearing serves as a support for the elongate body that allows the downward application of pressure on the elongate body with a power grip. Changing the bearing height and the bearing's ability to pivot on the hinge allows the bearing to adjust to various non-planar surfaces. The bearing can also include an air bearing which comprises a plurality of holes in the resin pad. Air bled from the exhaust of the sanding device or air supply line is fed through plumbing and the holes in the resin pad to reduce friction between the resin pad and the surface being sanded.

The elongate body can have a tubular shape covered with padding to reduce grip fatigue. A trigger may also be included that is operable to control power to the sanding device. The trigger has an elongated paddle shape that is attached to the clamp head and extends along the elongate body. The trigger can be attached to the clamp head using a pivot pin that allows the trigger to pivot when grasped. The trigger may also include an adjustment bolt positioned to contact a power switch on the sanding device. The adjustment bolt is adjustable to change the angular orientation of the trigger with respect to the elongate body. Alternatively, the trigger could be attached directly to the sanding head. The paddle shape allows the trigger to be grasped from several positions along the elongate body. Changing the orientation of the trigger allows for adjustment to suit different hand sizes and finger lengths.

The clamp head typically includes a pair of jaws connected by a jaw pin. The pair of jaws are operable to clamp the sanding device by at least partially encircling the sanding device. The pair of jaws may also include a draw bolt inserted through each jaw of the pair of jaws. Tightening of the draw bolt draws the jaws together in a pinching motion. The clamp head can also include a pivot mount in which the head end of the elongate body is free to slide and pivot. The pivot mount includes a slot and the head end of the body includes a ball mounted in the slot for sliding and pivoting therein.

The sander handle of the present invention reduces the risk of injury due to vibration and poor grip posture by allowing a random orbit sanding device to be held and controlled in a power grip. In the power grip the wrist is held in a neutral position, or slightly extended. The power grip allows good blood flow to the hand and fingers, reducing the incidence of Raynaud's disease and carpal tunnel syndrome. The ergonomic handle can be held securely overhead with the fingers relaxed. In addition, the ergonomic handle separates the forces required to control sanding direction and pressure from the more precision forces required to control the trigger. As a result, the operator can put more force on the sanding interface with less hand and wrist fatigue while still maintaining control using only one hand.

BRIEF DESCRIPTION OF THE DRAWINGS

Figure 1:
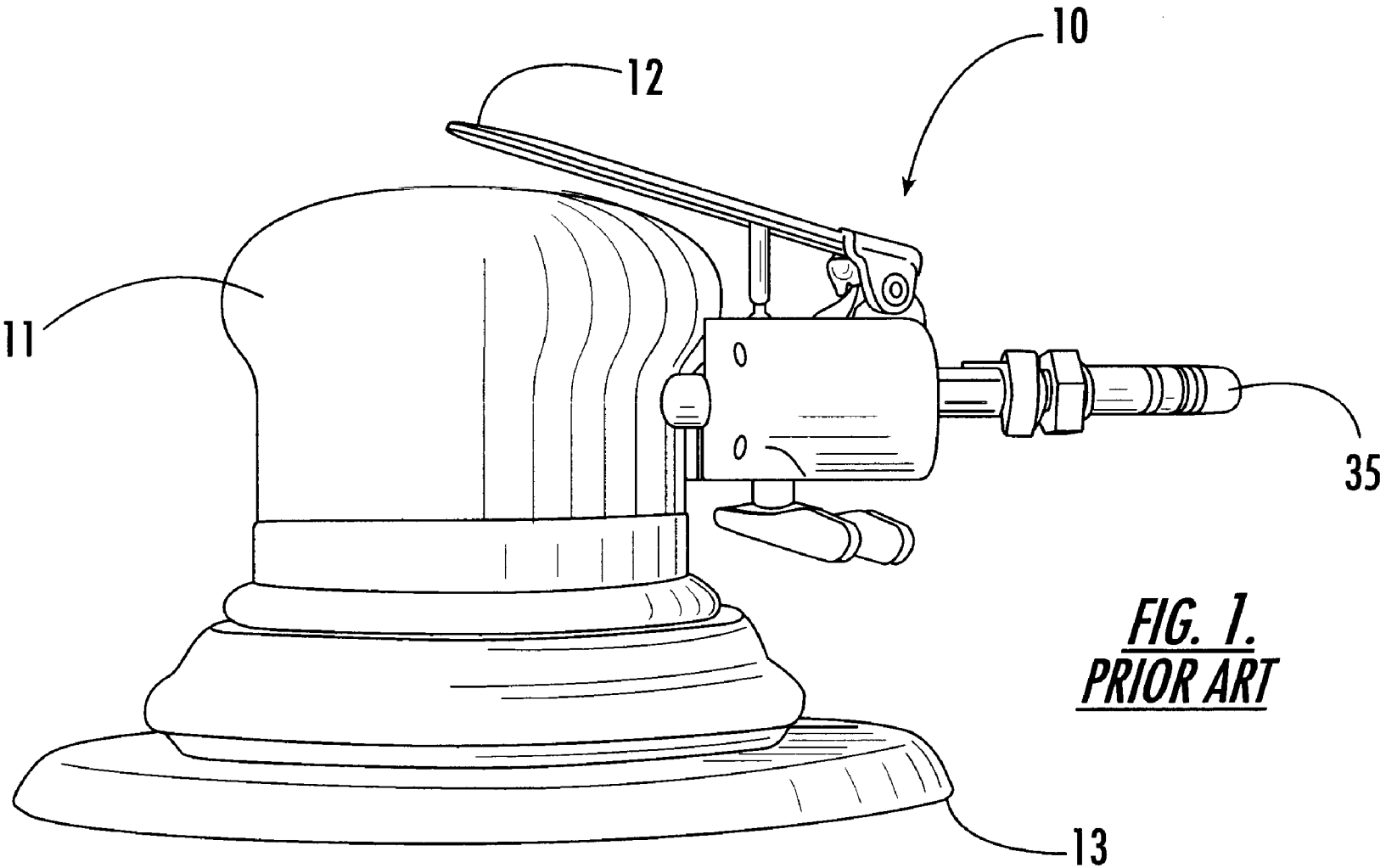
FIG. 1. PRIOR ART
Figures 2, 3:
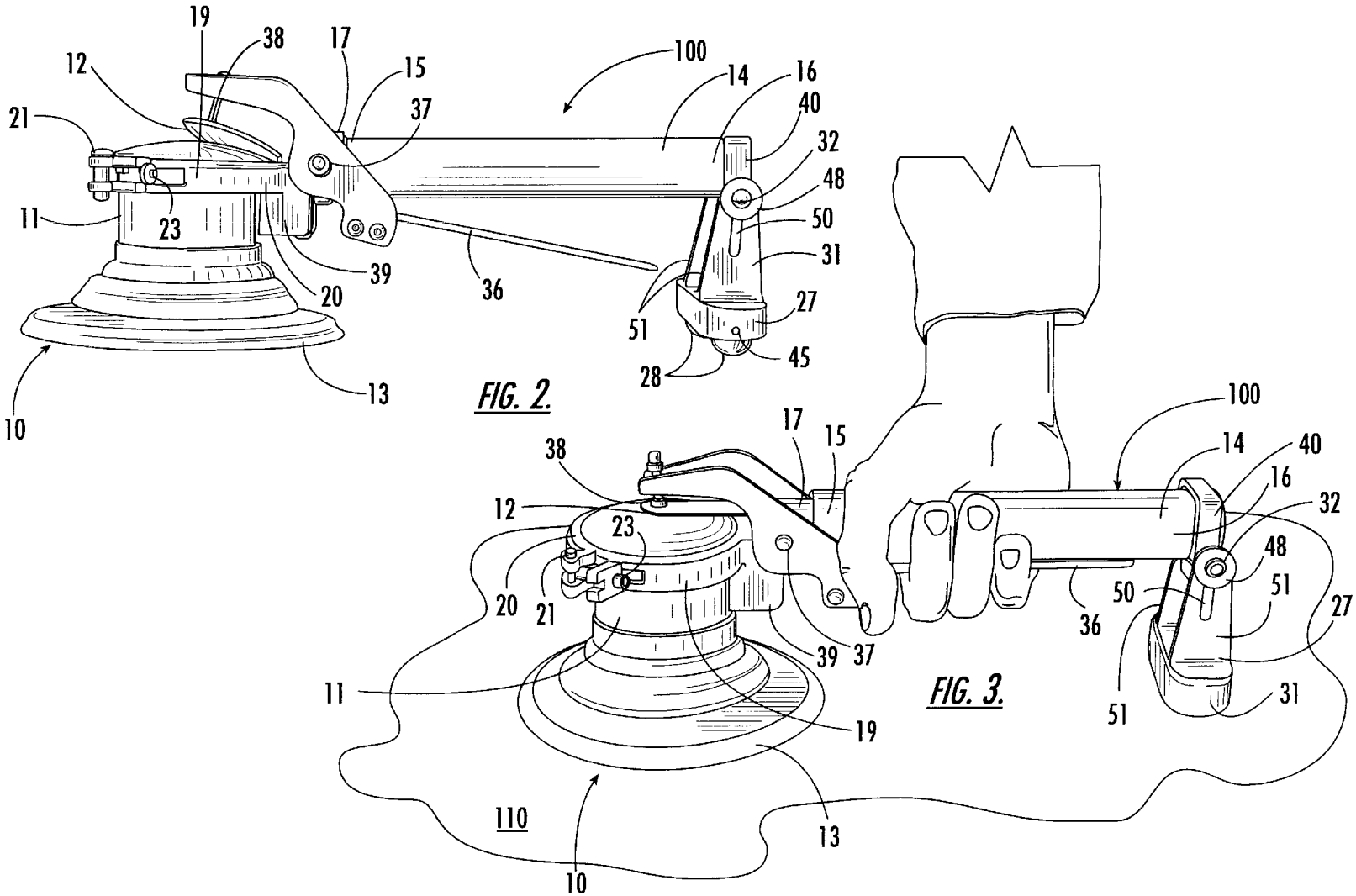
Figure 4:
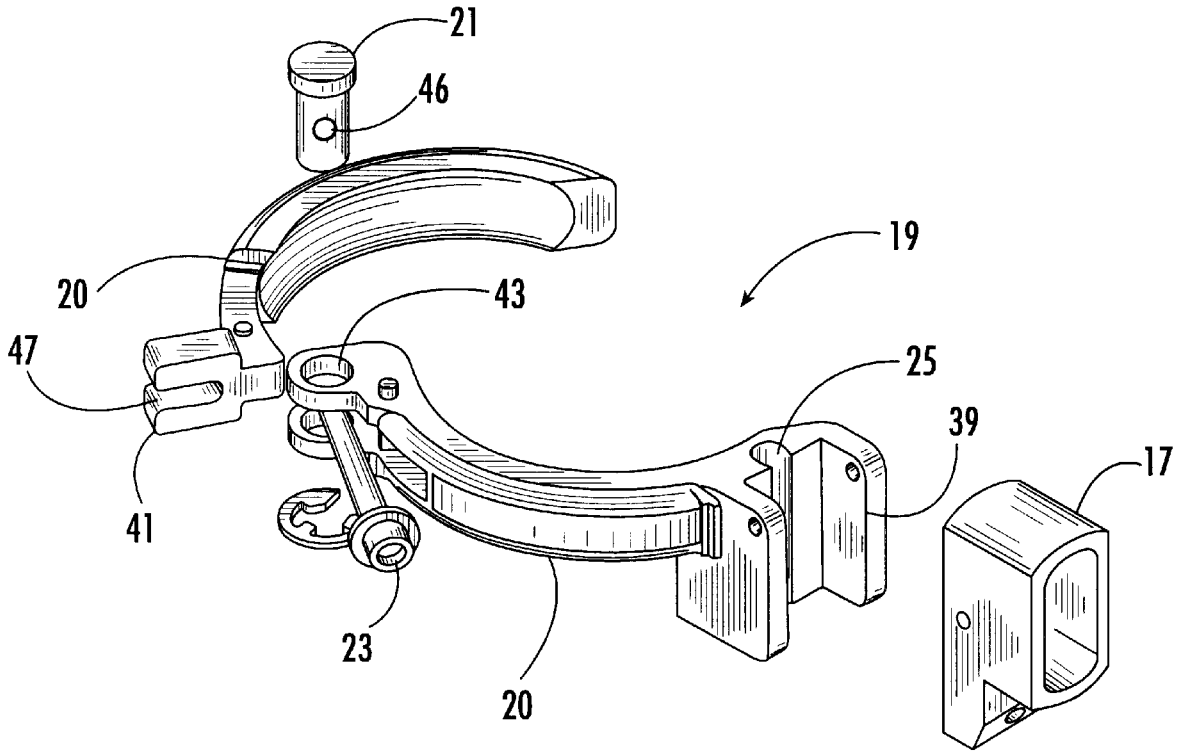
Figure 5A:
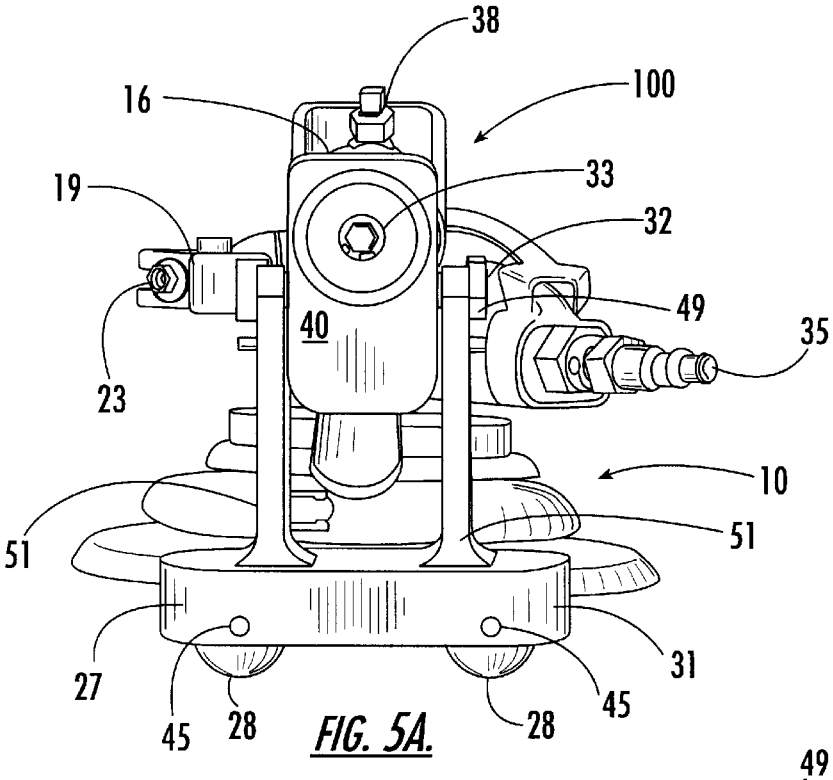
Figure 5B:
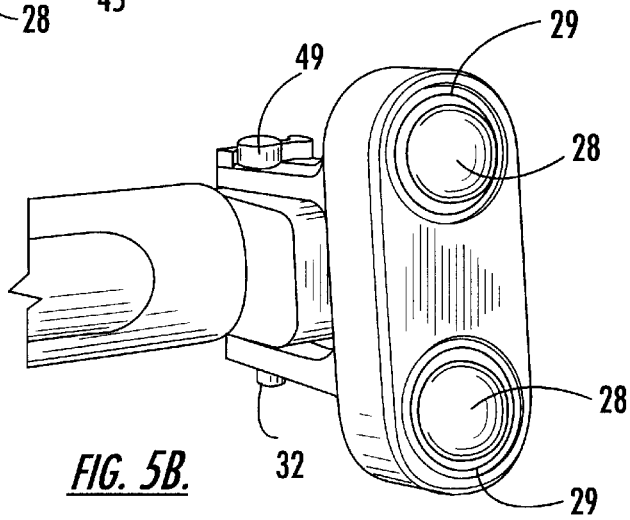
Figure 6:
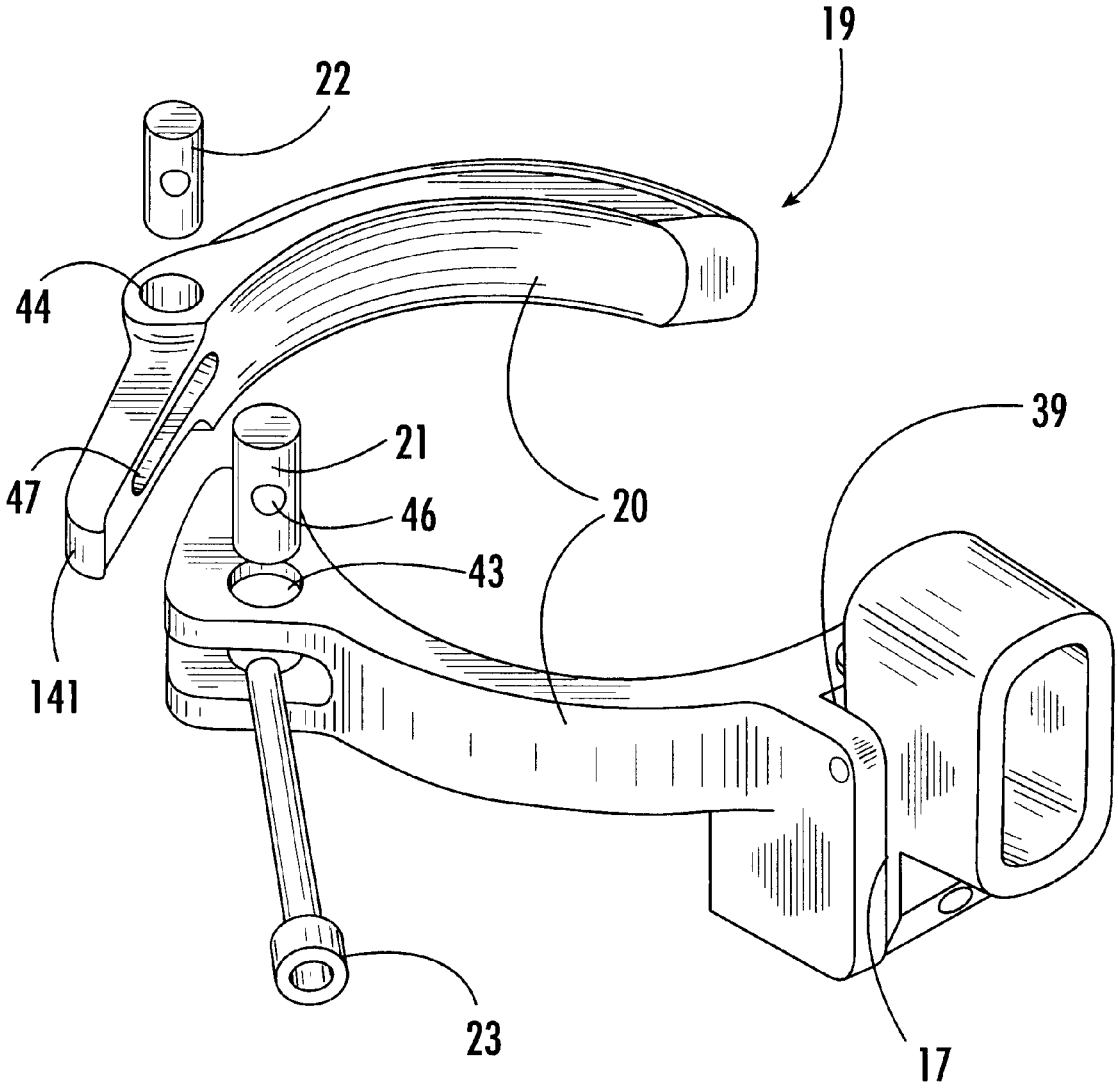
Figure 7:
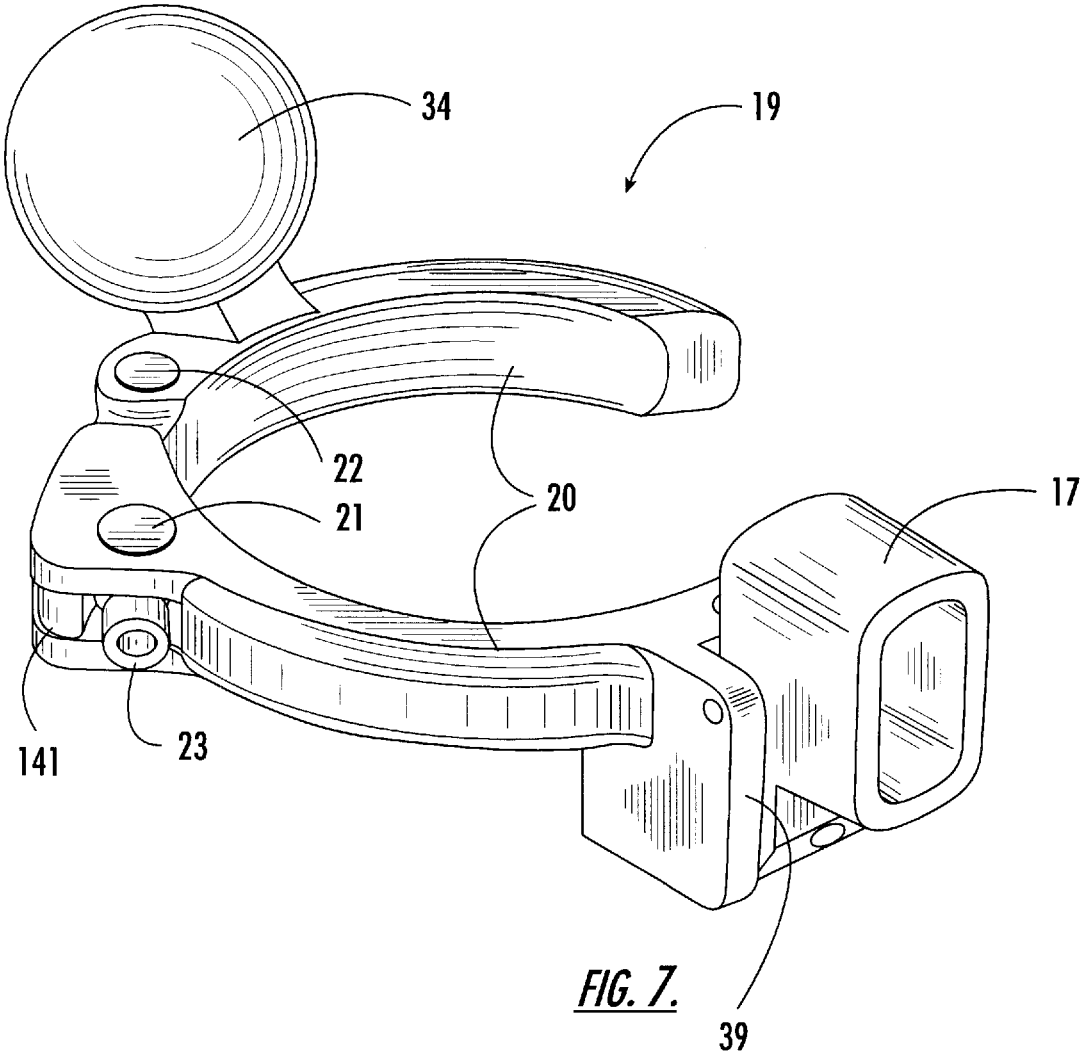
Figure 8:
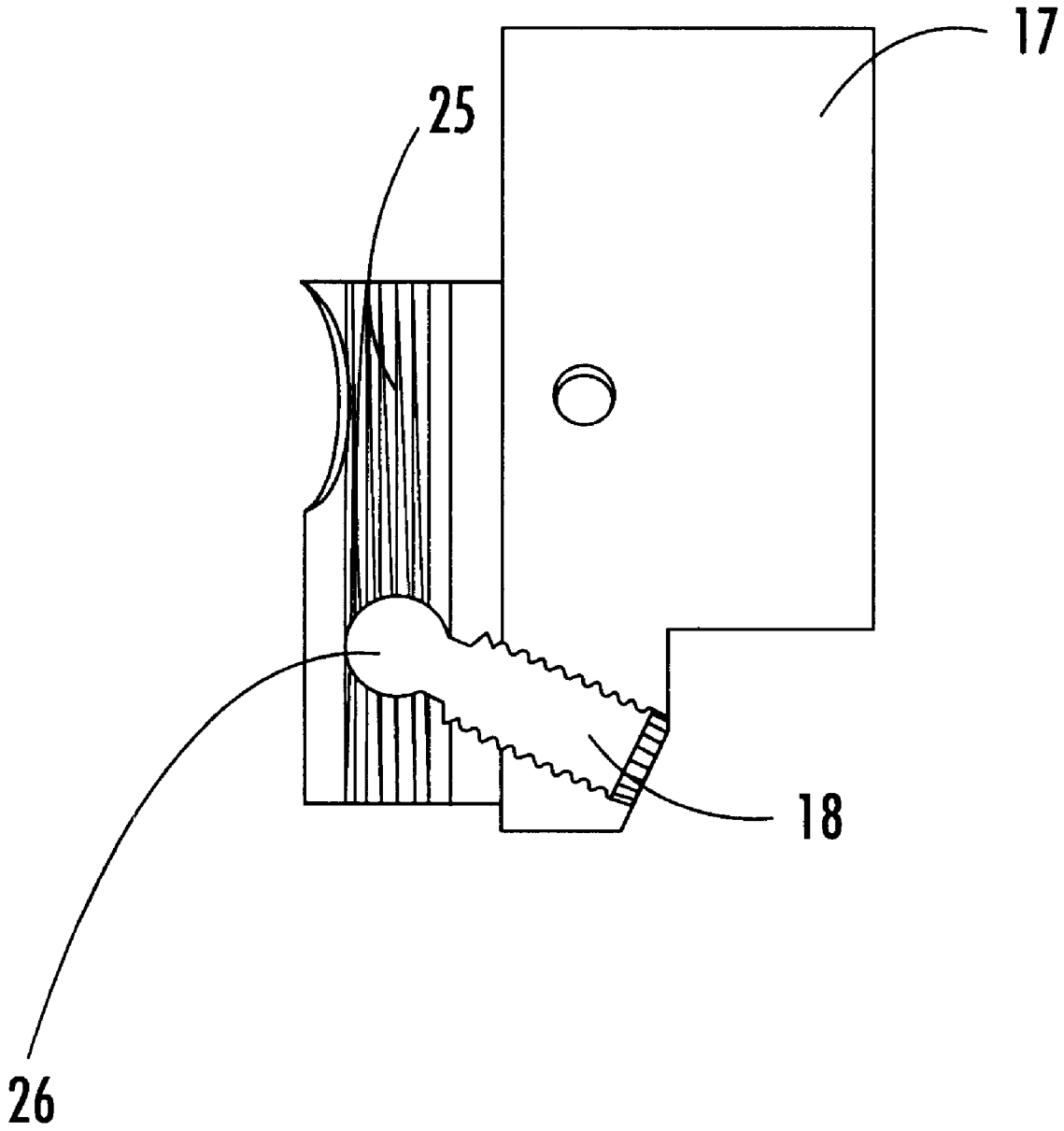

Having thus described the invention in general terms, reference will now be made to the accompanying drawings, which are not necessarily drawn to scale, and wherein:

FIG. 1 is a side elevation view of a conventional random orbit palm sander;

FIG. 2 is a side elevation view of an ergonomic handle of one embodiment the present invention clamped to the palm sander of FIG. 1;

FIG. 3 is a perspective view of the ergonomic handle of FIG. 2 gripped in the hand of a worker;

FIG. 4 is an exploded view of a clamp head of the ergonomic handle shown in FIG. 2;

FIG. 5A is a rear elevation view of a bearing of the ergonomic handle shown in FIG. 1;

FIG. 5B is a perspective view of the bearing shown in FIG. 5A;

FIG. 6 is a perspective view of a sliding cam clamp head of one embodiment of the present invention;

FIG. 7 is a perspective view of a ball fore grip on the sliding cam clamp head shown in FIG. 6; and FIG. 8 is a cut away view of a ball set screw forming a pivot mount of one embodiment of the present invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIG. 1 depicts a conventional pneumatically-powered sanding device, more particularly, a random orbit palm sander 10. The random orbit palm sander 10 has a power head 11, a trigger 12, and a sanding pad 13. A small diameter sanding disc (not shown) is typically fixed to the sanding pad 13. The random orbit action is generally achieved by use of an eccentric weight or cam in the drive of the sanding device 10 which causes the pad to orbit a center point while spinning at a high speed. Power can be supplied in various manners including electrical power, but in the illustrated embodiment power is supplied to the power head through a pneumatic connection 35. Power to the head is controlled by the trigger 12 which is activated when the user grips the power head in one hand and encloses fingers around the power head with the palm of the hand itself in extension with respect to the wrist.

FIG. 2 depicts one embodiment of the present invention including an ergonomic handle 100 attached to the random orbit palm sander 10. The ergonomic handle includes an elongate body 14, a clamp head 19, and a bearing 27. The clamp head 19 includes a pair of jaws 20 that wrap securely around a power head 11 of the sanding device 10. The clamp head 19 is also attached to a head end 15 of the elongate body 14. The bearing 27 is attached to a tail end 16 of the elongate body 14, opposite the head end, and preferably includes a pair of roller balls 28. The ergonomic handle 100 is employed by the worker by gripping the elongate body 14 in a single hand and placing the sanding device 10 and the bearing 27 in contact with a surface 110, as shown in FIG. 3. The worker activates power to the sanding device 10 by depressing a paddle trigger 36 which causes the trigger to rotate about an axle pin 37 and to depress the trigger 12 on the sanding device 10. Once power to the sanding device 10 is activated, the worker applies pressure to the elongate body 14 which compresses the sanding device 10 and the bearing 27 onto the surface 110. The worker then sweeps the sanding device 10 using the ergonomic handle 100 in a broad motion which, coupled with the pressure (downward in the illustrated embodiment) and oscillation of the sanding disk, sands the surface 110.

As shown in FIG. 4, the clamp head 19 preferably includes the pair of jaws 20, a first jaw pin 21, a clamp head draw bolt 23 and a clamp head clevis 39. The pair of jaws 20 are connected using the draw bolt 23 which fits through a retaining element 41 on one of the jaws and a cylindrical jaw pin 21 in the other one of the jaws. In more detail, the other one of the jaws 20 has a receptacle 43 that is aligned with the retaining element 41. Although the receptacle can be configured in different manners, the receptacle of the illustrated embodiment includes a pair of spaced apart members which are connected to opposite sides of the respective jaw and which define openings through which the jaw pin 21 extends. The cylindrical draw pin 21 fits into the receptacle and defines a hole 46 extending transverse to the length-wise direction of the jaw pin. The retaining element 41 defines a slot 47 that is aligned with the hole 46 of the jaw pin. The draw bolt 23 passes through the slot 47 defined by the retaining element 41 and the hole 46 defined by the cylindrical jaw pin 21 to secure the jaws together. After the pair of jaws 20 are fit around the molded power head 11 of the sanding device 10 they can be tightened with the clamp head draw bolt 23. Tightening the clamp head draw bolt results in a pinching action of the jaws 20 causing them to grip the molded power head 11 of the sanding device 10.

In addition to engaging the power head 11, the clamp head 19 is connected to the elongate body 14. In the illustrated embodiment, the head end 15 of the elongate body 14 fits into the clamp head clevis 39 to form a pivot mount. The pivot mount includes a slot 25 defined by the clamp head clevis 39 which receives a ball set screw 26 attached to a head fitting 17 of the elongate body 14 and allows handle angle adjustment as described later.

The clamp head 19 can be configured differently, however. By way of example, FIG. 6 depicts another embodiment of the clamp head 19 having a sliding cam that allows for a lower profile with fewer protuberances. The sliding cam is formed by an elongated, closed-end retaining element 141 and a second jaw pin 22. The second jaw pin is also cylindrically shaped and defines a hole, but it slidably fits into a second receptacle 44 defined by the jaw carrying the retaining element 141. The clamp head draw bolt 23 fits through the hole defined by the first pin 21, an elongated slot defined by the retaining element 141 and the hole defined by the second pin 22 to secure the jaws 20 together. FIG. 7 depicts yet another embodiment of the clamp head 19 that includes a ball grip 34 that allows two-handed use of the ergonomic handle 100 and the sanding device 10.

The bearing 27 allows the tail end of the ergonomic handle 100 to slide freely over the surface 110 as the ergonomic handle and sanding device 10 are employed to sand the surface. FIGS. 5A and 5B depict the bearing 27 which preferably includes a pair of roller balls 28 mounted in a height-adjustable bracket 31 which is attached to a tail fitting 40 at the tail end 16 of the elongate body 14. The pair of roller balls 28 are mounted in a pair of sockets 29 defined by the bracket 31 and are held there by a pair of set screws 45. The sockets 29 are drawn metal cans that capture and house the roller balls. The set screws 45 in the bracket 31 preferably contact only the sockets (i.e., the metal cans) 29, and not the roller balls 28 to avoid damage to the roller balls. The roller balls 28 are preferably plastic balls, but can be constructed of various other materials, such as metal. The roller balls 28 and their sockets 29 are common to the art and can be purchased in a range of sizes and materials, and are therefore not described herein in additional detail. The presence of the pair of roller balls 28 allows the tail end of the ergonomic handle 100 to be rested securely and without wobble on the sanding surface 110.

The bearing 27 could also employ other types of bearing surfaces or bearings, such as additional roller balls or fluoropolymer resin (e.g., TEFLON®) pads. The resin pads are interchangeable with the roller balls 28 and are preferably used when sanding on composite surfaces. The resin pads are preferably machined to fit into the sockets 29 in the bracket 31. The resin pads distribute the downward pressure applied to the handle 100 over a wider area to minimize the risk of denting the composite surface.

In another embodiment, the resin pads could include a plurality of holes through which bleed air from the exhaust of the sanding device 10 or air directly from an air supply line can be directed. Directing air through holes in the resin pads creates a cushion of air a few molecules thick under the resin pad. The cushion of air creates an air bearing that reduces the friction between the resin pads and the sanding surface 110. The effectiveness of the air bearing depends, in-part, on the available air flow under the resin pad and the surface area of the resin pad. The air bearing is generally more effective with a greater surface area and more air flow. The air bearing has the advantage of not requiring high air pressure, just high air flow which is possible with most air supply systems.

The tail fitting 40 of the elongate body 14 is attached to the bracket 31 via a pivot pin 32 about which the bracket is free to rotate. The pivot pin 32 extends through a pair of slots 50 defined by two spaced, upright members 51 of the bracket 31. The bracket 31 is height-adjustable by way of a washer 48 and a wing nut 49 that secure the ends of the pivot pin 32. The relative angle and position of the elongate body 14 with respect to the bearing 27 can be adjusted by loosening the wing nut 49 and sliding the tail fitting up or down inside the upright members 51 of the bracket and re-tightening the wing nut.

The elongate body 14 is typically constructed of a padded aluminum tube having the head fitting 17 at its head end 15 and the tail fitting 40 at its tail end 16. The fittings are secured to the ends of the elongate body 14 in one embodiment by a handle draw bolt 33 which runs the length of the elongate body. The head fitting 17 includes the ball set screw 18 as shown in FIG. 8. The head fitting 17 fits into the clamp head clevis 39 and the ball 26 at the end of ball set screw 18 slides within the slot 25 defined by the clamp head 19. The slot 25 and the ball 26 form a pivot mount that allows the relative orientation of the elongate body 14 to change with respect to the clamp head 19 and the sanding device 10.

The paddle trigger 36 of the illustrated embodiment has an elongate shape that extends along a part of the length of the elongate body 14. The front end of the paddle wraps around either side of the elongate body 14 and comes together on the top of the sanding device 10 just over the trigger 12. The paddle trigger 36 rotates about an axle pin 37 mounted to the clamp head clevis 39. The top end of the paddle trigger 36 also includes an adjustment bolt 38 that contacts the trigger 12 and sets the paddle trigger 36 angle with respect to the angle of the elongate body 14. This adjustment is necessary because the elongate body 14 and the paddle trigger 36 pivot independently on the axle pin 37.

The ergonomic handle 100 is attached to the sanding device 10 by encircling the power head 11 with the pair of jaws 20. The pair of jaws are opened by rotation about the jaw pin 21 when the draw bolt 23 has been loosened. The clamp head 19 is then secured to the sanding device power head 11 by tightening the draw bolt 23. The worker adjusts the bearing 27 to the desired height by loosening the wing nut 49 and sliding the pivot pin 32 up or down along the pair of slots 50 defined by the upright members 51. After the desired position is reached, the wing nut 49 is tightened to secure the pivot pin 32 in the slot 50 defined by the bracket 31. Adjusting the height of the bearing 27 changes the angle of the handle 100 with respect to the sanding device 10 and allows an optimum power grip (i.e., little or no flexion and deviation of the hand and wrist) on a range of surface types. The worker adjusts the angle of the paddle trigger 36 with respect to the elongate body 14 by adjusting the adjustment bolt 38.

Once the ergonomic handle 100 has been adjusted to a desired configuration, the worker can begin sanding. The ergonomic handle 100 is grasped in a single hand and the sanding pad 13 and the bearing 27 is placed on the surface 110. The worker applies downward pressure (or upward pressure in the case of overhead surfaces) on the elongate body 14 of the ergonomic handle 100 using a power grip having minimal flexion and extension of the hand and wrist. The worker grips the paddle trigger 36 with fingertips and pulls the paddle trigger toward the elongate body 14 which causes the paddle trigger to rotate about its axle pin 37. The top end of the paddle trigger 36 having the adjustment bolt 38 rotates downward to depress the trigger 12 on the power head 11 of the sanding device 10 activating a supply of air pressure through the pneumatic connection 35. Other methods of providing power and actuating the sander are also possible. Once the sanding pad 13 begins its random orbit, the worker moves the sanding pad and the bearing 27 along the surface 110 in a smooth motion while maintaining downward pressure on the ergonomic handle 100.

The present invention is not limited to retrofitting existing sanding devices. The ergonomic handle 100 could also be manufactured along with the sanding device 10 to construct an ergonomic sander. The ergonomic sander can have a similar elongate body for easy grasping of the sander and a bearing for supporting one end of the sander. However, the elongate body could be formed integrally with a housing for the sanding device power head and a bracket for the bearings. Also, other types of power such as electrical and hydraulic could be used to produce the random orbit motion of the pad 13. The present invention is not limited to random orbit motion sanders, but could also include other sanding devices such as oscillating sanders and belt sanders.

The ergonomic handle 100 of the present invention reduces the risk of injury due to vibration and poor grip posture by allowing a random orbit sanding device to be held and controlled in a power grip. In the power grip the wrist is held in a neutral position, or slightly extended. The power grip allows good blood flow to the hand and fingers, reducing the incidence of Raynaud's disease and carpal tunnel syndrome. The ergonomic handle can be held securely overhead with the fingers relaxed. In addition, the ergonomic handle separates the forces required to control sanding direction and pressure from the more precision forces required to control the trigger. As a result, the operator can put more force on the sanding interface with less hand and wrist fatigue while still maintaining control using only one hand.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An ergonomic handle for clamping onto a sanding device so that the ergonomic handle can be gripped by a worker and used to apply the sanding device to a surface, said ergonomic handle comprising:

an elongate body having a head end and an opposing tail end;

a clamp head attached to the head end of the elongate body and operable to clamp a power head of the sanding device therein; and a bearing attached to the tail end of the elongate body, opposite the clamp head, so that the worker can clamp the clamp head onto the power head of the sanding device, grip the elongate body, apply the sanding device and bearing to the surface and move the sanding device and bearing along the surface during sanding.

2. The ergonomic handle of claim 1, wherein said bearing comprises a fluoropolymer resin pad.

3. An ergonomic handle for clamping onto a sanding device so that the ergonomic handle can be gripped by a worker and used to apply the sanding device to a surface, said ergonomic handle comprising:

an elongate body having a head end and an opposing tail end;

a clamp head attached to the head end of the elongate body and operable to clamp the sanding device therein; and a bearing attached to the tail end of the elongate body, opposite the clamp head, wherein said bearing comprises a fluoropolymer resin pad and wherein said resin pad includes a plurality of holes and an air flow supply operably connected to the plurality of holes and dispensing air flow therethrough to create an air bearing so that the worker can clamp the clamp head onto the sanding device, grip the elongate body, apply the sanding device and bearing to the surface and move the sanding device and bearing along the surface during sanding.

4. The ergonomic handle of claim 1, wherein said bearing comprises a tail roller having at least one freely rotating roller ball.

5. An ergonomic handle for clamping onto a sanding device so that the ergonomic handle can be gripped by a worker and used to apply the sanding device to a surface, said ergonomic handle comprising:

an elongate body having a head end and an opposing tail end;

a clamp head attached to the head end of the elongate body and operable to clamp the sanding device therein; and a bearing attached to the tail end of the elongate body, opposite the clamp head, wherein said bearing comprises an air bearing so that the worker can clamp the clamp head onto the sanding device, grip the elongate body, apply the sanding device and bearing to the surface and move the sanding device and bearing along the surface during sanding.

6. The ergonomic handle of claim 1, wherein said bearing includes a hinge that pivots with respect to the tail end of the elongate body.

7. The ergonomic handle of claim 1, wherein said bearing includes a height-adjustable bracket mounted to the tail end and operable to adjust the height of the handle with respect to the bearing.

8. The ergonomic handle of claim 1, wherein said elongate body has a tubular shape.

9. The ergonomic handle of claim 8, wherein said elongate body further comprises padding.

10. An ergonomic handle for clamping onto a sanding device so that the ergonomic handle can be gripped by a worker and used to apply the sanding device to a surface, said ergonomic handle comprising:

an elongate body having a head end and an opposing tail end;

a clamp head attached to the head end of the elongate body and operable to clamp the sanding device therein;

a trigger operable to control power to the sanding device; and a bearing attached to the tail end of the elongate body, opposite the clamp head, so that the worker can clamp the clamp head onto the sanding device, grip the elongate body, apply the sanding device and bearing to the surface and move the sanding device and bearing along the surface during sanding.

11. The ergonomic handle of claim 10, wherein said trigger has an elongated paddle shape attached to the clamp head and extending along the elongate body.

12. The ergonomic handle of claim 11, wherein said trigger comprises an axle pin to facilitate pivotal attachment of the clamp head.

13. The ergonomic handle of claim 12, wherein said trigger includes an adjustment bolt positioned to contact a power switch on the sanding device and adjustable to change an angular orientation between the trigger and the elongate body.

14. The ergonomic handle of claim 1, wherein said clamp head comprises a pair of jaws and a jaw pin connecting the pair of jaws, said pair of jaws operable to clamp the sanding device by at least partially encircling the sanding device.

15. An ergonomic handle for clamping onto a sanding device so that the ergonomic handle can be gripped by a worker and used to apply the sanding device to a surface, said ergonomic handle comprising:

an elongate body having a head end and an opposing tail end;

a clamp head attached to the head end of the elongate body, said clamp head including a pair of jaws, a jaw pin connecting the pair of jaws and a draw bolt inserted through each jaw of the pair of jaws so that tightening of the draw bolt draws the jaws together in a pinching motion to clamp the sanding device therein by at least partially encircling the sanding device; and a bearing attached to the tail end of the elongate body, opposite the clamp head, so that the worker can clamp the clamp head onto the sanding device, grip the elongate body, apply the sanding device and bearing to the surface and move the sanding device and bearing along the surface during sanding.

16. The ergonomic handle of claim 1, wherein said clamp head includes a pivot mount in which the head end of the elongate body is free to slide and pivot.

17. An ergonomic handle for clamping onto a sanding device so that the ergonomic handle can be gripped by a worker and used to apply the sanding device to a surface, said ergonomic handle comprising:

an elongate body having a head end including a ball and an opposing tail end;

a clamp head attached to the head end of the elongate body and operable to clamp the sanding device therein, said clamp head including a pivot mount defining a slot and wherein the ball of the head end is mounted in the slot for sliding and pivoting therein; and a bearing attached to the tail end of the elongate body, opposite the clamp head, so that the worker can clamp the clamp head onto the sanding device, grip the elongate body, apply the sanding device and bearing to the surface and move the sanding device and bearing along the surface during sanding.

18. An ergonomic handle for clamping onto a sanding device so that the ergonomic handle can be gripped by a worker and used to apply the sanding device to a surface, said ergonomic handle comprising:

an elongate body having a head end and an opposing tail end;

a clamp head attached to the head end of the elongate body, including a ball fore grip and operable to clamp the sanding device therein; and a bearing attached to the tail end of the elongate body, opposite the clamp head, so that the worker can clamp the clamp head onto the sanding device, grip the elongate body and ball fore grip, apply the sanding device and bearing to the surface and move the sanding device and bearing along the surface during sanding.

19. An ergonomic handle for clamping onto a sanding device so that the ergonomic handle can be gripped by a worker and used to apply the sanding device to a surface, said ergonomic handle comprising:

an elongate body having a head end and an opposing tail end;

a clamp head comprising a pair of jaws, a pair of jaw pins and a draw bolt, one of the jaw pins being housed in each jaw and said draw bolt extending through each of the jaw pins so that tightening of the draw bolt draws the jaws together in a cam motion to clamp the sanding device therein; and a bearing attached to the tail end of the elongate body, opposite the clamp head, so that the worker can clamp the clamp head onto the sanding device, grip the elongate body, apply the sanding device and bearing to the surface and move the sanding device and bearing along the surface during sanding.

20. An ergonomic sander that can be gripped by a worker and used to sand a surface, said ergonomic sander comprising:

an elongate body having a head end and an opposing tail end;

a power head of a sanding device attached to the head end of the elongate body and having a sanding interface operable to sand the surface; and a bearing attached to the tail end of the elongate body, opposite the power head and spaced therefrom, so that the worker can grip the elongate body, apply the sanding interface and bearing to the surface and move the sanding interface and bearing along the surface during sanding.

21. The ergonomic sander of claim 20, wherein said bearing comprises a fluoropolymer resin pad.

22. The ergonomic sander of claim 20, wherein said bearing comprises a tail roller having at least one freely rotating roller ball.

23. An ergonomic sander that can be gripped by a worker and used to sand a surface, said ergonomic sander comprising:

an elongate body having a head end and an opposing tail end;

a sanding head attached to the head end of the elongate body and having a sanding interface operable to sand the surface; and an air bearing attached to the tail end of the elongate body, opposite the sanding head and spaced therefrom, so that the worker can grip the elongate body, apply the sanding interface and air bearing to the surface and move the sanding interface and air bearing along the surface during sanding.

24. The ergonomic sander of claim 20, wherein said bearing includes a hinge that pivots with respect to the tail end of the elongate body.

25. The ergonomic sander of claim 20, wherein said bearing includes a height-adjustable bracket mounted to the tail end and operable to adjust the height of the handle with respect to the bearing.

26. The ergonomic sander of claim 20, wherein said elongate body has a tubular shape.

27. The ergonomic sander of claim 26, wherein said elongate body further comprises padding.

28. An ergonomic sander that can be gripped by a worker and used to sand a surface, said ergonomic sander comprising:

an elongate body having a head end and an opposing tail end;

a sanding head attached to the head end of the elongate body and having a sanding interface operable to sand the surface;

a trigger operable to control power to the sanding device; and a bearing attached to the tail end of the elongate body, opposite the sanding head and spaced therefrom, so that the worker can grip the elongate body, apply the sanding interface and bearing to the surface, pull the trigger and move the sanding interface and bearing along the surface during sanding.

29. The ergonomic sander of claim 28, wherein said trigger has an elongated paddle shape attached to the sanding head and extending along the elongate body.

30. The ergonomic sander of claim 29, wherein said trigger comprises an axle pin to facilitate pivotal attachment to the clamp head.

31. A method of attaching an ergonomic sander handle to a sanding device and using the ergonomic sander handle and sanding device to sand a surface, comprising:

attaching a clamp head on a head end of an elongate body of the ergonomic sander handle to a power head of the sanding device;

hand gripping the elongate body of the ergonomic sander handle between the head end and an opposing tail end of the elongate body;

applying a bearing coupled to the tail end of the elongate body and a sanding interface of the sanding device coupled to the head end of the elongate body to the surface; and sanding the surface by applying pressure to the ergonomic sander handle and moving the sanding interface and bearing about the surface.

32. A method of attaching an ergonomic sander handle to a sanding device and using the ergonomic sander handle and sanding device to sand a surface, comprising:

attaching a clamp head on a head end of an elongate body of the ergonomic sander handle to the sanding device by partially encircling the sanding device with a pair of jaws of the clamp head by rotating the jaws about a pivot pin;

hand gripping the elongate body of the ergonomic sander handle between the head end and an opposing tail end of the elongate body;

applying a bearing coupled to the tail end of the elongate body and a sanding interface of the sanding device coupled to the head end of the elongate body to the surface; and sanding the surface by applying pressure to the ergonomic sander handle and moving the sanding interface and bearing about the surface.

33. The method of claim 32, wherein said attaching a clamp head further includes tightening a draw bolt of the clamp head and drawing the jaws together in a pinching motion.

34. A method of attaching an ergonomic sander handle to a sanding device and using the ergonomic sander handle and sanding device to sand a surface, comprising:

attaching a clamp head on a head end of an elongate body of the ergonomic sander handle to the sanding device;

hand gripping the elongate body of the ergonomic sander handle between the head end and an opposing tail end of the elongate body;

applying a bearing coupled to the tail end of the elongate body and a sanding interface of the sanding device coupled to the head end of the elongate body to the surface;

gripping a trigger extending along the elongate body and triggering operation of the sanding device before sanding the surface; and sanding the surface by applying pressure to the ergonomic sander handle and moving the sanding interface and bearing about the surface.

35. The method of claim 31, further comprising adjusting a height-adjustable bracket mounted to the tail end and repositioning the elongate body with respect to the bearing.

* * * * *